72-158 SF
10/15/85 OR 4,546,632

United States Patent [19]

Van Den Kieboom et al.

[11] Patent Number: 4,546,632

[45] Date of Patent: Oct. 15, 1985

[54] PORTABLE CONDUIT BENDING APPARATUS

[75] Inventors: Jan M. Van Den Kieboom, Greendale; Ingo Valentin, Brookfield, both of Wis.

[73] Assignee: Applied Power Inc., Brookfield, Wis.

[21] Appl. No.: 626,581

[22] Filed: Jun. 29, 1984

Related U.S. Application Data

[63] Continuation of Ser. No. 368,278, Apr. 14, 1982, abandoned.

[51] Int. Cl.[4] ..... B21D 7/024

[52] U.S. Cl. ..... 72/158; 72/155; 72/159; 72/482; 29/125

[58] Field of Search ..... 72/157-159, 72/155, 154, 149, 472, 473, 477, 478, 482, 217, 219; 29/125

[56] References Cited

U.S. PATENT DOCUMENTS

| | | | |
|---|---|---|---|
| 493,390 | 3/1893 | Stirling | 72/155 |
| 682,671 | 9/1901 | Condon | 72/158 |
| 1,135,875 | 4/1915 | Brinkman | 72/158 |
| 1,139,434 | 5/1915 | Moore | 72/158 |
| 1,309,849 | 7/1919 | Henderson | 72/477 |
| 1,714,083 | 5/1929 | Frank | 72/155 |
| 1,899,280 | 2/1933 | Lidseen | 72/477 |
| 1,899,281 | 2/1933 | Lidseen | 72/159 |
| 1,930,999 | 10/1933 | Gaskell | 29/125 |
| 3,147,792 | 9/1964 | Hautau | 72/157 |
| 3,299,681 | 1/1967 | Hautau | 72/157 |
| 3,417,590 | 12/1968 | Ensley | 72/159 |
| 3,584,492 | 6/1971 | Dodge et al. | 72/159 |
| 3,621,697 | 11/1971 | Martinko | 72/219 |
| 3,921,424 | 11/1975 | Pearson | 72/158 |
| 3,949,584 | 4/1976 | Pearson et al. | 72/157 |
| 4,025,749 | 5/1977 | Spurr et al. | 29/125 |
| 4,249,407 | 2/1981 | Fogleman | 72/159 |

FOREIGN PATENT DOCUMENTS

| | | | |
|---|---|---|---|
| 161177 | 12/1979 | Japan | 72/482 |
| 1091631 | 11/1967 | United Kingdom | 72/387 |

*Primary Examiner*—Daniel C. Crane

*Attorney, Agent, or Firm*—Andrus, Sceales, Starke & Sawall

[57] ABSTRACT

A portable electric driven conduit bender which accommodates rigid, IMC and thinwall conduit of various sizes in a single setup includes a rotatable, cone-shaped bending shoe, and a roller assembly for supporting conduit during bending. The bending shoe has a pair of arcuate-shaped die portions positioned diametrically opposite one another for shaping rigid and IMC conduit, and thinwall conduit, respectively, and each die portion has a plurality of bending grooves formed therein for accommodating various conduit diameter sizes. The roller assembly includes a roller unit for larger diameter conduit that has a split forming roller and a solid backup roller located side-by-side which cradle the conduit during the bending operation. One of the halves of the split roller is adjustable in its axial direction between a closed position for supporting thinwall conduit and a separated position for supporting rigid conduit. A lever arm is used to rotate an eccentric which moves the roller unit into an operation position for bending and an inoperative position for inserting or removing conduit. The lever includes a roller handle which acts as a backup roller for bending smaller diameter conduit.

18 Claims, 7 Drawing Figures

2
14
16
48
49
50
51
52
53
54
59
60
61
66
68
69
70
71
72
73
74
75
76
77
78
79
80
81
82
83
85
86
87
88
89
90
91
92
93

2
51
52
54
55
56
57
59
61
62
63
64
66
67
68
69
79
80
81
83
86
88
91
92
93

PORTABLE CONDUIT BENDING APPARATUS

This application is a continuation of application Ser. No. 368,278, filed Apr. 14, 1982, now abandoned.

BACKGROUND OF THE INVENTION

The present invention relates to metal working, and more particularly to bending metal conduit, pipe, tubing and the like to a preselected angle.

In various industries, such as the construction and plumbing industries, it is often necessary to bend metal conduit and pipe to a desired angle. Metal conduit and pipe, however, are manufactured in various nominal diameter sizes having various wall thicknesses which are generally referred to as steel and aluminum "rigid" conduit and pipe, IMC conduit and pipe, or "thinwall" (EMT) conduit. These various sizes and types of conduit and pipe have created numerous problems in the design of manual and power driven bending apparatuses. For example, a rigid steel conduit having a 1 inch nominal diameter has an actual outer diameter which is greater than the actual outer diameter of a 1 inch nominal size thinwall conduit. As a result, a plurality of different bending shoes or dies having a hemispherical recess or groove formed therein which matches the size of the conduit and pipe being bent have generally been used in the past in order to provide sufficient support during bending. Shoes having a plurality of different size grooves formed therein have also been used as shown in Hautau, U.S. Pat. No. 3,299,681.

Another type of problem exists when bending larger sizes of thinwall conduit and pipe. The relatively thin wall of this type of conduit and pipe tends to collapse inwardly or kink during bending. Therefore, some means for supporting the inside face of the bend or for cold working the wall of the bend by either stretching or squeezing during bending is needed to prevent collapsing or kinking of the walls. See for example Hautau, U.S. Pat. No. 3,147,792. Other problems well known in the art of bending include providing for easy removal of conduit and pipe after bending, slippage during bending, and springback after bending.

Various power driven bending apparatus have been developed. One such arrangement is shown in Pearson et al, U.S. Pat. No. 3,949,584 wherein there is provided a rotating bending shoe and a roller unit utilizing a pair of rollers acting in tandem for supporting conduit during the bending operation. The rollers shown in the Pearson et al patent, however, may only be utilized with a limited range of conduit diameters and wall thicknesses. As a result, multiple roller units must be utilized to cover the full range of conduit and pipe sizes and types available in the marketplace. Another arrangement is shown in U.S. Pat. No. 4,249,407 in which conduit is bent around a stationary circular die by a rotating member. Other bending machines are shown in U.S. Pat. Nos. 3,417,590 and 1,899,281. Nevertheless, none of the above known bending apparatuses are capable of accommodating the numerous conduit diameters and wall thicknesses available in a single arrangement without the necessity of providing multiple interchangeable bending components for the apparatus.

It is thus desirable to provide a bending apparatus which may accommodate conduit of various diameters and wall thicknesses as well as solve the aforementioned problems.

SUMMARY OF THE INVENTION

An improved conduit bending apparatus is provided which includes a bending shoe rotatably mounted on a frame and a roller assembly for supporting conduit during bending. The apparatus accommodates conduit and pipe of various diameters and wall thicknesses without the necessity of changing bending components. This is accomplished by providing the bending shoe with a plurality of bending grooves which accommodate various diameter sizes of rigid, IMC and thinwall conduit and pipe, and by providing the roller assembly with a rotatable roller means having an axially movable portion which may be adjusted to accommodate the different wall thicknesses of rigid and thinwall conduit and pipe.

The bending shoe is cone-shaped and includes a pair of arcuate-shaped die portions positioned diametrically opposite one another. One die portion is utilized to shape rigid and IMC conduit and pipe, and the other die portion is utilized to shape thinwall (EMT) conduit. The die portions include a plurality of stacked bending grooves or recesses formed therein with each groove having a diameter different from the others and substantially equal to the outer diameter of the conduit or pipe being bent.

The roller assembly includes a roller housing which supports a plurality of roller units comprising twin sets of grooved rollers which cradle and support the conduit during the bending operation. Each set of rollers includes one split roller and a solid companion roller located side-by-side in the roller housing on respective shafts. The split roller is a form roller which shapes the conduit during bending and the companion roller is a backup roller which absorbs the moment during bending. Each split roller can accommodate a particular size thinwall conduit or rigid and IMC conduit and pipe by moving one of its roller halves axially to change the effective diameter of the roller groove. When the roller halves are in their closed position the split roller is used for supporting thinwall conduit and pipe, and when in their separated position the split roller is utilized with rigid and IMC conduit and pipe.

The axially movable half of the split roller is adjustable in the axial direction by means of a key member. The adjusting key member controls the axial position of the roller shaft thus controlling the position of the roller half. This adjustment is accomplished by providing the adjusting key with an inclined cam surface and by providing the roller shaft with a corresponding projecting pin member. When the key member is moved in a direction perpendicular to the axis of the split roller, the cam surface engages the pin member and forces the roller shaft to move axially to either close or separate the roller halves.

The roller assembly also includes means for moving the roller units between an inoperative position which permits easy insertion and removal of conduit and pipe between the rollers and bending shoe, and an operative position wherein the rollers squeeze the conduit against the bending shoe for bending. In the operation position, the bending shoe grooves are closely aligned with the grooves in the rollers of the roller assembly for good tracking purposes. The operative position also provides for the squeezing of thinwall conduit and pipe which is necessary in order to obtain a kink-free bend. This means for moving the roller units between operative and inoperative positions comprises an eccentric and a lever arm for rotating the eccentric. The lever arm includes a dual function handle at its free end. The handle not only functions as a gripping means for rotating the lever arm, but also serves as a backup roller when bending smaller diameter conduit or pipe.

The drive mechanism for the bending shoe also provides an arrangement which aids in balancing the bending force on the shoe shaft during bending. This is accomplished by locating a chain and sprocket arrangement of a speed reduction means for the drive mechanism above the frame of the bending apparatus in such a position that the radial force created on the shoe shaft by the chain and sprocket arrangement opposes the squeezing force applied against the conduit or pipe during bending.

Other objects and advantages will appear during the course of the following description.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
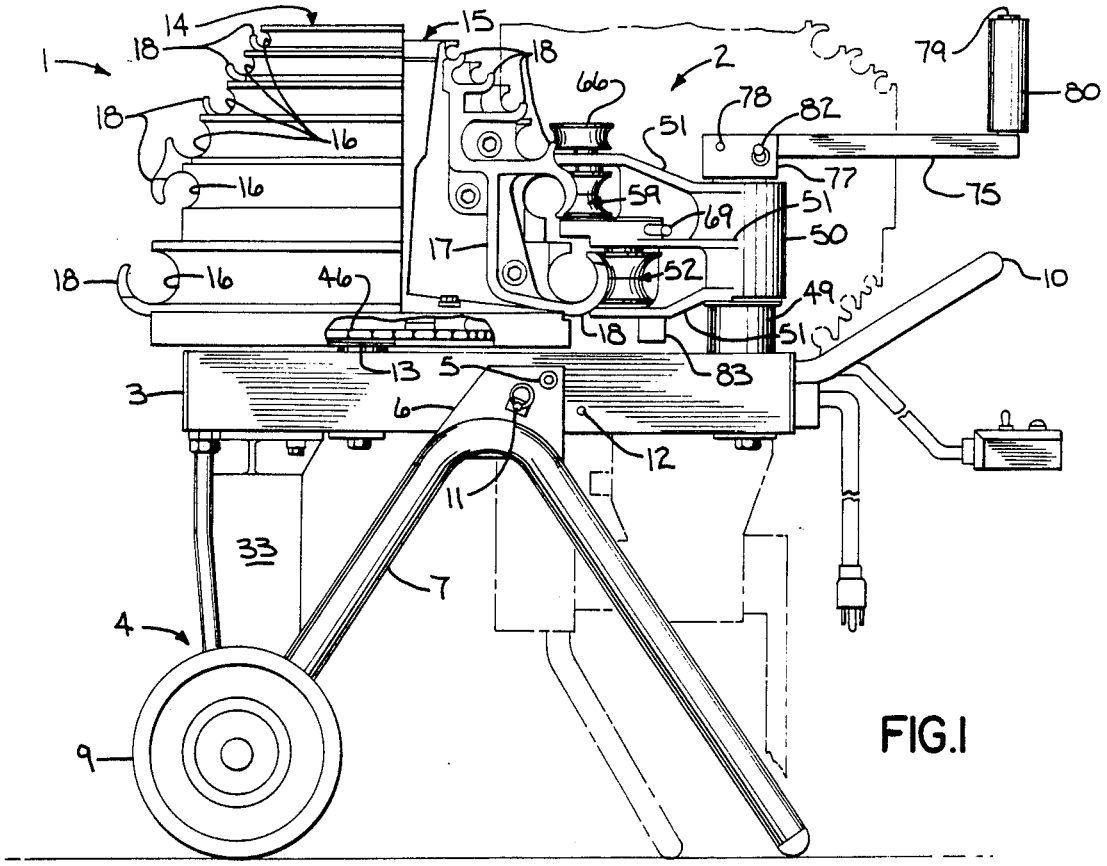
FIG. 1 is a side view in elevation of a portable electric driven conduit bender made in accordance with the principles of the present invention with the bending shoe positioned vertically.
Figure 2:
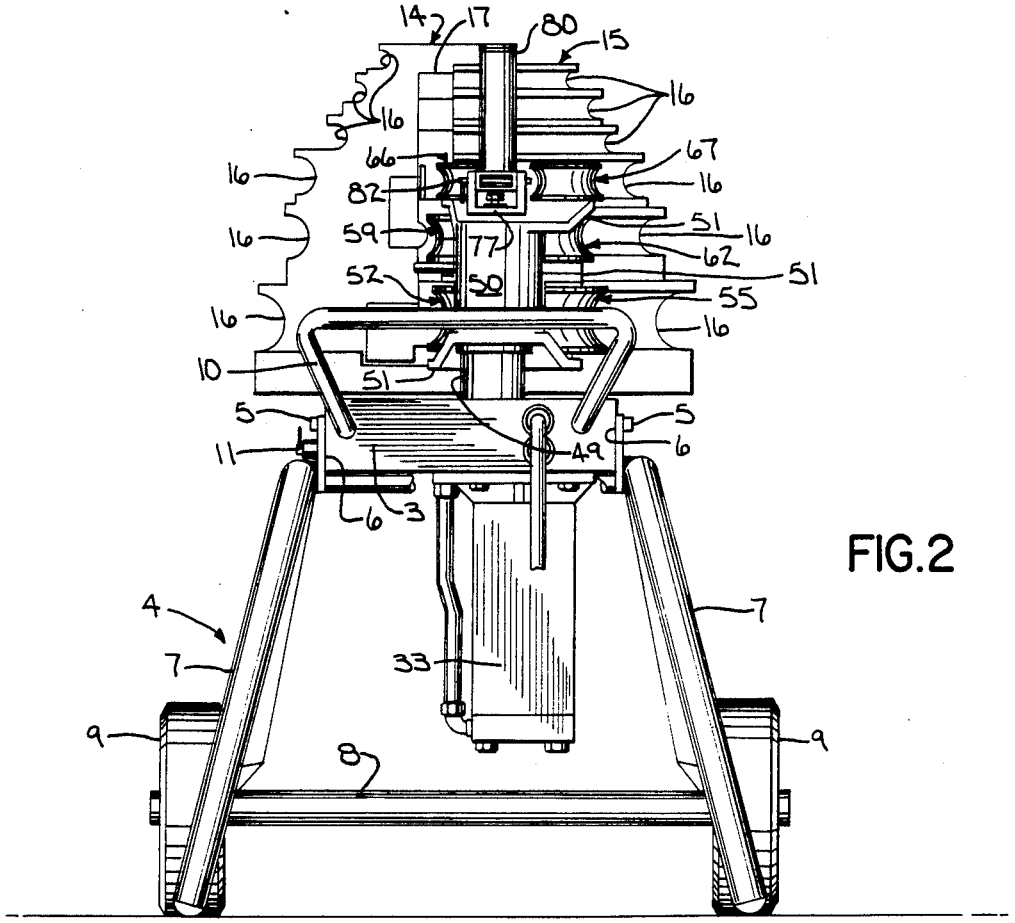
FIG. 2 is a rear view in elevation with parts broken away of the conduit bender of FIG. 1.

Referring now to the drawings, FIGS. 1 and 2 show a bending apparatus constructed in accordance with the principles of the present invention. The conduit bender includes a rotatable bending shoe 1 and a roller assembly 2 both mounted on a frame 3. The frame 3 is hollow and rectangular in cross section, and is pivotally mounted to a carriage 4. The pivotal connection of frame 3 to carriage 4 is provided by a pair of pivot pins or bolts 5 each of which extends through one of the side walls of frame 3 into a trunnion member 6. Each trunnion member 6 is welded to an inverted V-shaped support member 7 and the members 7 are connected together at their forward ends by a cross-bar member 8 which lends added rigidity and support to the carriage 4. Each support member 7 also includes a wheel 9 rotatably mounted at its forward end which provides mobility for the bending apparatus. A handle 10 is connected to the rear wall of frame 3 and enables an operator to lift upwards on the rear end of the bending apparatus and push it to the desired bending location.

Figure 7:
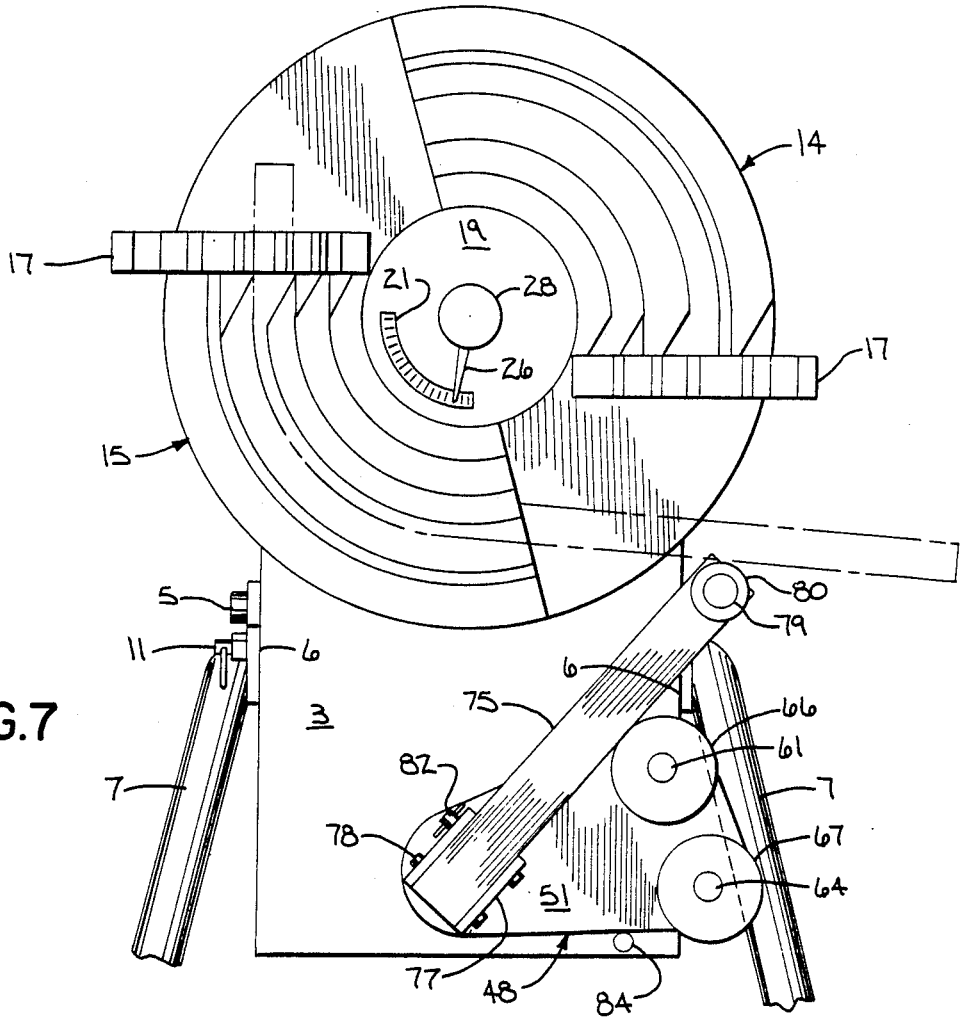
FIG. 7 is a view in elevation of the conduit bender with the bending shoe positioned horizontally and showing the roller assembly in its operative position for bending smaller diameter conduit.

The pivotal connection of the frame 3 to carriage 4 is located approximately at the midpoint of the length of frame 3 in order to provide a balanced apparatus not only when the apparatus is stationary during bending, but also when the apparatus is moved from place to place by an operator. Frame 3 is maintained in the horizontal position shown in FIG. 1 by means of a spring-loaded retainer pin 11 that extends through one of the trunnions 6 into a detent (not shown) in the side of the frame 3. When it is desired to rotate frame 3 into a vertical position, as shown in FIG. 7 and in phantom in FIG. 1, the pin 11 is pulled outwardly to release it from its locked position in frame 3. Frame 3 is then pivoted or rotated so that its rear end moves downwardly and its front end moves upwardly in a clockwise direction as seen in FIG. 1. Retainer pin 11 then snaps into a second detent 12 formed in the side of frame 3 when frame 3 has been sufficiently rotated. Thus, shoe 1 may be positioned horizontally for an operator that prefers this position for bending conduit and pipe.

Bending shoe 1 is generally cone-shaped and is mounted on a shaft 13 extending from frame 3. As seen best in FIG. 7, bending shoe 1 has a pair of arcuate-shaped die portions 14 and 15 positioned diametrically opposite one another for shaping rigid and IMC, and thinwall conduit, respectively. Each die portion 14 and 15 has a plurality of stacked bending grooves 16 formed therein along its periphery for accommodating various diameter sizes.

Each bending groove 16 extends arcuately about the circular bending shoe 1 for approximately 115°. Each of the arcuate bending grooves 16 includes a hemispherical recess of a diameter differing from the others and substantially equal to the outer diameter of the conduit or pipe desired to be bent in that particular bending groove 16. For example, the lowermost groove 16 of both die portions 14 and 15 is designed for use with a 2 inch nominal conduit diameter size. Groove 16 in die portion 14 which is utilized with rigid and IMC conduit and pipe would thus have a diameter of about 2.388 inches which substantially corresponds to the actual outer diameter of a 2 inch nominal diameter size for IMC and rigid conduit and pipe. Correspondingly, the diameter of the lowermost groove 16 for die portion 15 which is utilized with thinwall or EMT conduit has a radius of about 2.204 inches which substantially corresponds to the actual outer diameter of a 2 inch nominal diameter size thinwall conduit. The next higher bending groove 16 is designed for use with $1\frac{1}{2}$ inch nominal sizes and the remaining grooves are designed for use with $1\frac{1}{4}$ inch, 1 inch, $\frac{3}{4}$ inch and $\frac{1}{2}$ inch nominal diameter conduit sizes in ascending order in FIGS. 1 and 2, respectively. Thus, the uppermost bending groove 16 for die portion 14 extends slightly above the uppermost groove 16 for die portion 15 since the diameters of the grooves 16 of die portion 14 are slightly greater than the diameters of grooves 16 of die portion 15.

As seen in FIG. 1 each die portion 14 and 15 also includes a pipe retainer 17 bolted to one of its sides. The pipe retainer 17 includes a plurality of hooks 18 for retaining one end of the conduit in alignment with its respective groove 16 in shoe 1. As shown, there is a hook 18 for each groove 16 and each hook 18 is comprised of an arcuate portion having a diameter substantially equal to the diameter of its corresponding groove 16.

Bending shoe 1 further includes a means for controlling the degree of bend. This means is shown in FIGS.

3 and 7 and includes an angle plate 19 in frictional engagement along its periphery with an 0-ring 20 seated in bending shoe 1. As seen best in FIG. 7, plate 19 includes a curved scale 21 which is marked in degrees for determining the degree of bend desired. Plate 19 is welded to a tubular collar 22 which in turn is welded to a contactor 23 which engages a return limit switch 24 which is mounted on a rotating base plate 25 connected to the shoe shaft 13. A pointer 26 is connected to a friction plate 27 by means of a knob 28 which is connected to a shaft 29 and contactor 30. An 0-ring 31 permits relative movement between friction plate 27 and angle plate 19, and contactor 30 is utilized to engage a bend limit switch 32 which is also mounted on base plate 25. Thus, in order to set the degree of bend the angle plate 19 is rotated until contactor 23 trips limit switch 24 to indicate a zero set position. Pointer 26 is then rotated to the desired angle as indicated on scale 31. When bending shoe 1 rotates the desired number of degrees, contactor 30 will trip limit switch 32 to prevent further rotation of shoe 1. The electronic circuitry necessary to accomplish the desired degree of bend utilizing such an arrangement may be of any conventional design and thus need not be described herein.

Figure 3:
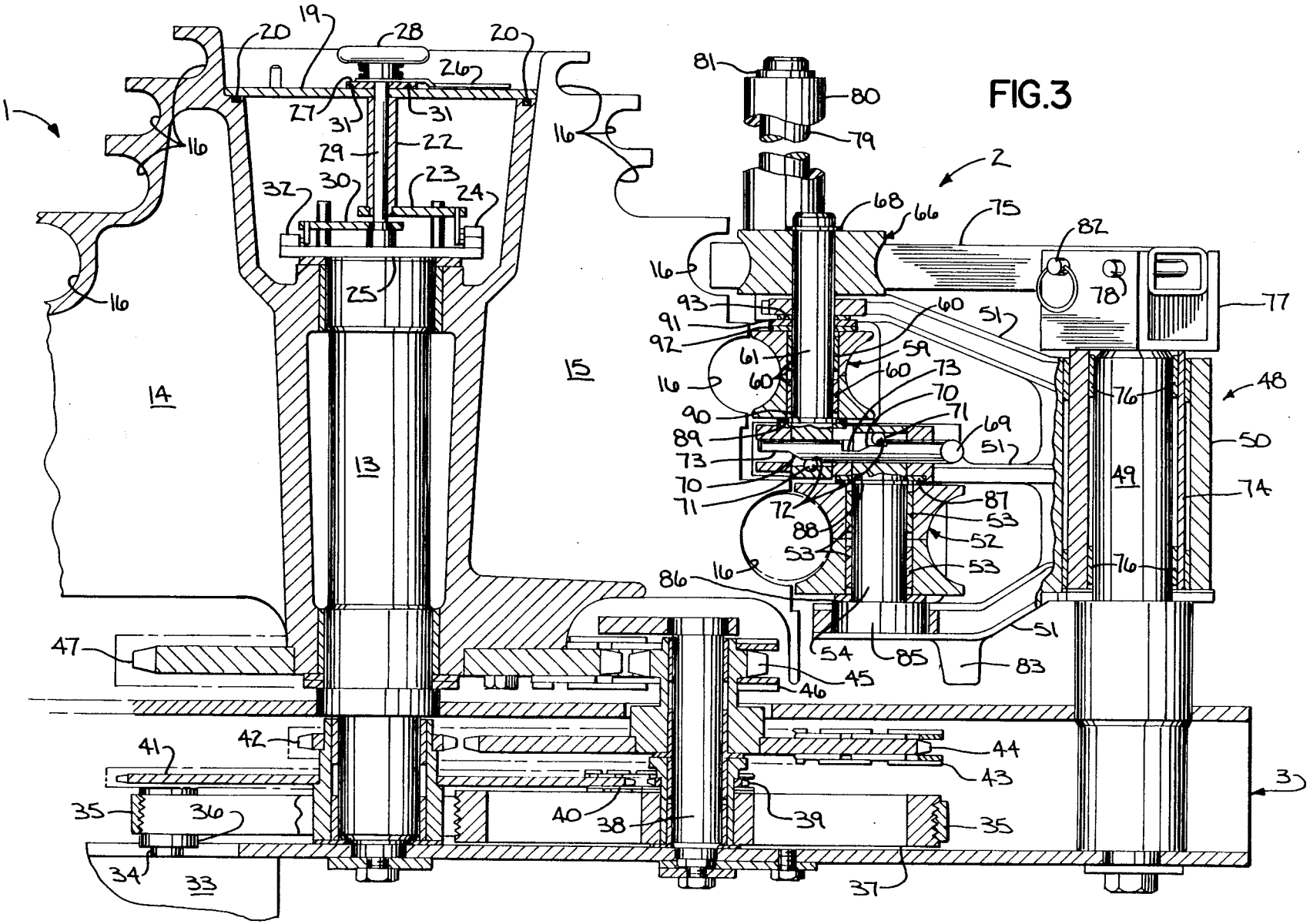
FIG. 3 is a fragmentary side elevational view in cross section showing the split forming rollers of the roller assembly closed for bending thinwall conduit.

Bending shoe 1 is rotated by means of an electric motor 33 bolted to the undersurface of frame 3. A speed reduction is also incorporated between motor shaft 34 and bending shoe 1. As seen in FIG. 3, this speed reduction is provided by a belt and pulley arrangement together with a plurality of chain and sprocket arrangements. However, as is readily obvious to those skilled in the art, various other speed reduction arrangements are also possible. As shown in FIG. 3, the first reduction from the motor 33 includes a drive belt 35 wrapped around a pulley 36 mounted on motor shaft 34 and a second pulley 37 mounted for rotation on a sprocket shaft 38 which is supported in frame 3 and which is parallel to shoe shaft 13 and space therefrom. Pulley 37 is integrally connected with a sprocket wheel 39 having teeth arranged to fit into the links of a chain 40. The chain 40 also interfits with the teeth of a sprocket wheel 41 mounted on shoe shaft 13. Sprocket wheel 41 is integrally connected with another sprocket wheel 42 which rotates about shoe shaft 13 and has its teeth arranged to fit into the links of a chain 43. The links of chain 43 also interfit with the teeth of another sprocket wheel 44 mounted for rotation on sprocket shaft 38. Sprocket wheel 44 is integrally connected with another sprocket wheel 45 which is also mounted for rotation on shaft 38 and disposed above frame 3. The teeth of sprocket wheel 45 fit into a chain 46 and the links of chain 46 also fit into the teeth of a sprocket wheel 47 which is connected to the bending shoe 1 and is coaxial with shoe shaft 13.

The positions of sprocket wheels 45 and 47 are an important feature of the conduit bender. Since wheels 45 and 47 are located above the frame 3 they develop a force during rotation of shoe 1 that is directed radially outward from shaft 13 to the right shown in FIG. 3. This force opposes the radially inwardly directed bending force on shoe shaft 13 developed during bending when roller assembly 2 squeezes conduit against the grooves 16 of shoe 1. Thus, the bending force acting on shoe shaft 13 is reduced by positioning the chain 46 and sprocket wheels 45 and 47 above the frame 3.

The conduit bender also includes a roller assembly 2 that comprises a roller housing 48, three separate roller units mounted on the housing 48 for supporting conduit during bending, and a lever arm assembly for moving the roller units between an operative and an inoperative position. The roller housing 48 is supported for rotation by means of a stationary support shaft 49 which is mounted to the rear end of frame 3. Roller housing 48 includes a hollow column portion 50 which surrounds support shaft 49 and three web portions 51 extending from column portion 50 each of which support a roller unit at its free or outer end.

Figure 5:
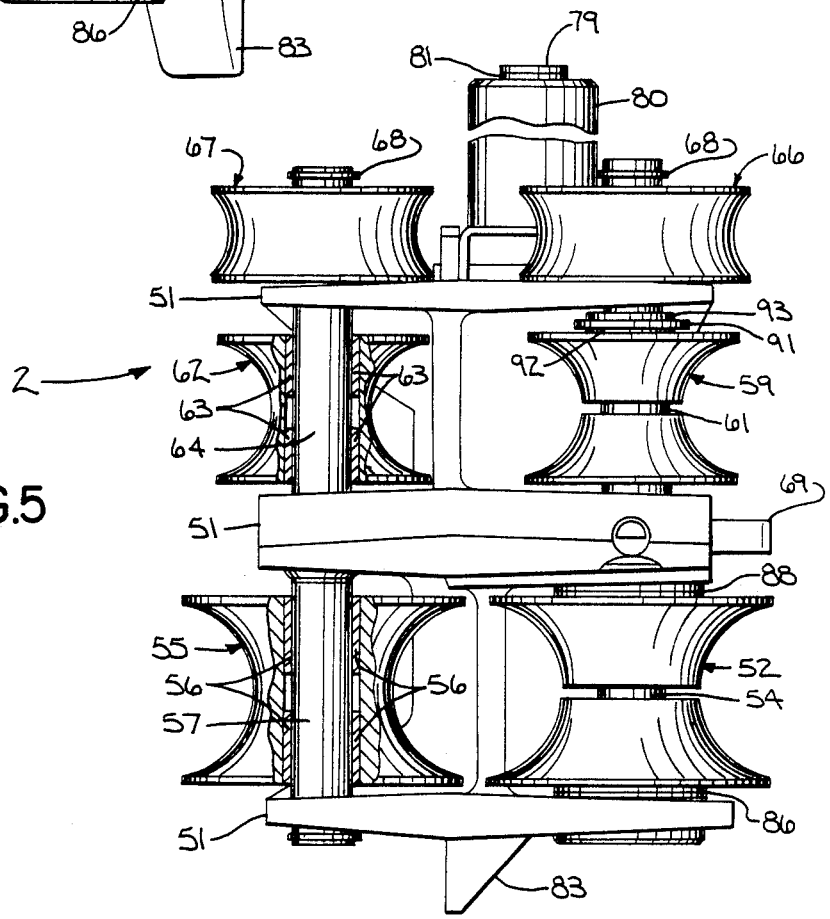
FIG. 5 is a front elevational view with parts broken away of the roller assembly of FIG. 4.

Each roller unit includes a twin set of grooved rollers located side-by-side in roller housing 48 on respective shafts which support and cradle the larger size conduit during bending. As seen in FIG. 5, the lowermost set of rollers includes roller 52 split into two discs which are rotatably mounted by means of thrust bearings 53 on a roller shaft 54, and a solid companion roller 55 rotatably mounted by means of thrust bearings 56 on a second roller shaft 57. Roller shafts 54 and 57 extend between the lower and middle web portions 51 of roller housing 48 with shaft 57 being spaced from shaft 54 and having an axis of rotation parallel thereto. It should be noted that roller shaft 54 is slidably mounted for movement in an axial direction at its opposite ends in the lower and middle web portions 51, as seen best in FIG. 3. Shaft 54 includes an enlarged flange portion 85 at its lower end which slides in the lower web portion 51 which forms an annular shoulder that retains roller 52 on shaft 54, and limits the axial movement of the lower half of roller 52, as will hereinafter be described. A thrust washer 86 is located between the lower half of roller 52 and portion 85 which acts as a bearing when roller 52 rotates. Another thrust washer 87 and a washer 88 are located between the upper half of roller 52 and the middle web portion of housing 48, and limit the axial movement of the upper half of roller 52.

The second or middle roller unit also includes a roller 59 split into two discs which are mounted for rotation by means of thrust bearing 60 on a roller shaft 61, and a solid companion roller 62 mounted for rotation by means of bearings 63 on a roller shaft 64. The shafts 61 and 64 extend from the middle web portion 51 of roller housing 48 through the upper web portion 51, and roller shaft 61 is axially slidably mounted in a manner similar to roller shaft 54 of the lower roller unit, as seen best in FIG. 3. A thrust washer 89 and a washer 90 are located between the lower half of roller 59 and the middle web portion 51 which limit the axial movement of the lower half of roller 59. Another thrust washer 91 and a washer 92 are positioned between a retaining ring 93 affixed on shaft 61 and the upper half of roller 59 which limit the axial movement of the upper half of roller 59. The middle roller unit is thus constructed substantially identical to the lower roller unit with the exception that the groove in rollers 59 and 62 of the middle unit is designed for use with a 1½ inch nominal diameter conduit whereas the groove in rollers 52 and 55 of the lower unit are designed for use with 2 inch nominal diameter conduit.

The third or upper roller unit includes a solid grooved roller 66 mounted for rotation on the upper end of roller shaft 61, and a solid companion grooved roller 67 mounted for rotation about the upper end of roller shaft 64. Both rollers 66 and 67 are retained on their respective shafts 61 and 64 by means of lock washers 68. As seen in FIG. 3, the grooves in rollers 66 and 67 are sized for use with 1¼ inch nominal diameter conduit and are sized for rigid conduit measurements.

Each roller unit thus comprises a pair of grooved rollers located side-by-side in the roller housing 48 on respective shafts. The split rollers 52 and 59 and the solid roller 66 are form rollers which shape the conduit during the bending operation whereas their solid companion rollers 55, 62 and 67 are backup rollers which take up the moment during bending. The companion rollers 55, 62 and 67 as well as roller 66 are all sized for rigid conduit measurements. In contrast, the split rollers 52 and 59 are adjustable in their axial direction and may be used with rigid, IMC and thinwall conduit. This adjustment feature allows one roller setup in housing 48 for different conduit outside diameters, and thus split rollers 52 and 59 may be utilized with the grooves 16 of either die portion 14 or 15 of bending shoe 1. This adjustment feature eliminates the need to provide a plurality of interchangeable rollers as is presently common in the industry.

Figure 4:
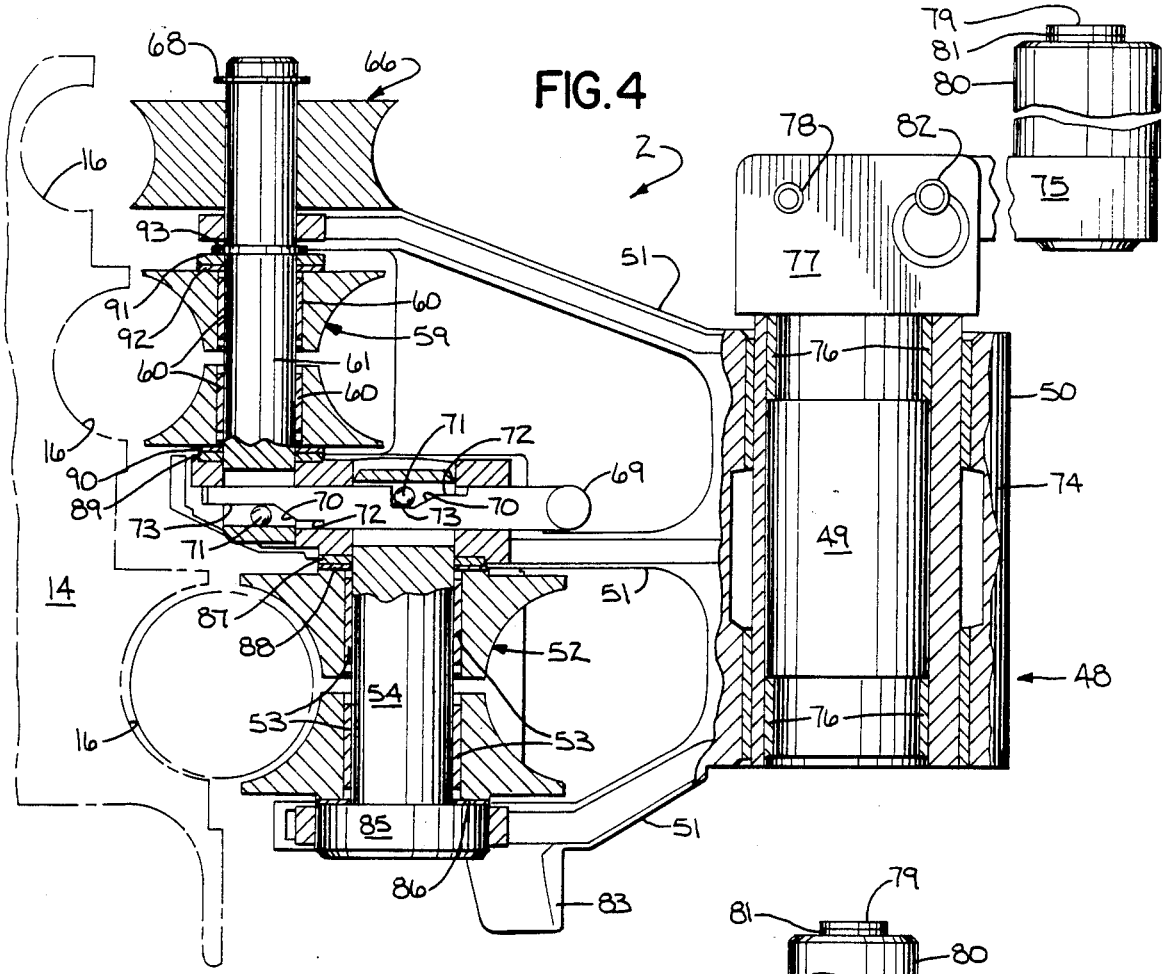
FIG. 4 is a fragmentary side elevation view in cross section similar to FIG. 3 showing the split forming rollers of the roller assembly separated for bending rigid and IMC conduit and pipe.

The split rollers 52 and 59 are adjustable in their axial direction by means of a key member 69. Key member 69 is slidably mounted in the middle web portion 51 for movement in a direction normal to the axis of rotation of rollers 52 and 59. Key member 69 includes a pair of inclined cam surfaces 70 formed therein. Each surface 70 engages a loading pin 71 which projects from the roller shafts 54 and 61 to move the shafts 54 and 61 simultaneously in opposite axial directions. As seen in FIGS. 3 and 4, one pin 71 is located at the upper end of roller shaft 54 and the other pin 71 is located at the lower end of roller shaft 61. Key member 69 also includes a landing area 72 at the outer ends of each cam surface 70 and a second landing area 73 at the inner end of each cam surface 70.

In operation, when key member 69 is in the position shown in FIG. 3 wherein the loading pins 71 are positioned on the landing areas 72, the split rollers 52 and 59 are in their closed positions. In their closed positions the split rollers 52 and 59 are utilized with 2 inch or ½ inch thinwall conduit and the grooves 16 in die portion 15 of bending shoe 1. When key member 69 is moved to the right as shown in FIG. 4, wherein loading pins 71 move inwardly along their respective cam surfaces 70 to the landing areas 73, the roller shafts 54 and 61 are slidably moved axially in the web portions 51 in opposite directions to permit split rollers 62 and 59 to move to their separated or opened positions when a conduit is squeezed between either roller 62 or 59 and a groove 16 of shoe 1. In their separated positions, split rollers 52 and 59 are utilized with 2 inch or ½ inch rigid or IMC conduit and the grooves 16 of die portion 14 of bending shoe 1. When key member 69 is moved to the right, loading pins 79 move from landing areas 72 down the inclined cam surfaces 70 to landing areas 73 thus causing roller shaft 54 to move downwardly and roller shaft 61 to move upwardly, as seen in FIG. 4. The downward axial movement of shaft 54 results in both halves of roller 52 moving downwardly by gravity so that a gap or space develops between the upper half of roller 52 and thrust washer 87. When a 2 inch nominal size conduit is then positioned between roller 52 and the 2 inch size groove 16 of shoe 1, and roller 52 is moved to its operative position whereby it squeezes the conduit, the upper half of roller 52 moves axially upwardly to engage thrust washer 87. The diameter of roller 52 is thus properly sized to substantially correspond to the outer diameter of 2 inch rigid or IMC conduit and pipe. The upward axial movement of shaft 61 results in a gap forming between thrust washer 91 and the upper half of roller 59 since both halves of roller 59 are forced by gravity against thrust washer 89. When a ½ inch nominal size conduit is then positioned between roller 59 and the 1½ inch size groove 16 of shoe 1, and roller 59 is moved to its operative position whereby it squeezes the conduit, the upper half of roller 59 moves axially upwardly to engage thrust washer 91. The diameter of roller 59 is thus properly sized to substantially correspond to the outer diameter of 1½ inch rigid or IMC conduit and pipe.

When it is desired to utilize rollers 52 and 59 with thinwall conduit, key member 69 is slid to the left so that loading pins 71 are forced along the inclined cam surfaces 70 from landing areas 73 to landing areas 72. The axial movement of shaft 54 causes the enlarged flange portion 85 on shaft 54 to move the lower half of roller 52 upwardly, and the axial movement of shaft 61 causes the retaining ring 93 on shaft 61 to move the upper half of roller 59 downwardly so that the lower half of split roller 52 and the upper half of split roller 59 are moved to their closed positions, as seen in FIG. 3. In their closed position the diameters of rollers 52 and 59 are thus properly sized to substantially correspond to the outer diameter of thinwall conduit. Thus, the upper and lower halves of rollers 52 and 59 comprise axially movable members which change the effective diameter of the grooves in rollers 52 and 59.

The lever arm assembly of the conduit bender includes an eccentric 74 and a lever arm 75 connected thereto for rotating eccentric 74. As seen in FIG. 3, the eccentric 74 encircles the stationary roller housing support shaft 49 and is positioned between the shaft 49 and column portion 50 of roller housing 48. Eccentric 74 is mounted for rotation about the shaft 49 by means of bearings 76 at its opposite ends, and its upper end is welded to the undersurface of a U-shaped bracket 77 for rotation therewith. Rotation of eccentric 74 thus moves the roller housing 48 and the roller units mounted thereon back and forth, i.e. from left to right and right to left as seen in FIG. 3.

The lever arm 75 is pivotally mounted to the bracket 77 at one end by means of a pin 78 extending through the arm 75 and the opposite sides of bracket 77. A handle 79 having a polyurethane grip portion 80 is mounted on the opposite or free end of lever arm 75. Grip portion 80 is free to rotate with respect to handle 79 and is retained on handle 79 by means of a lock washer 81.

Figure 6:
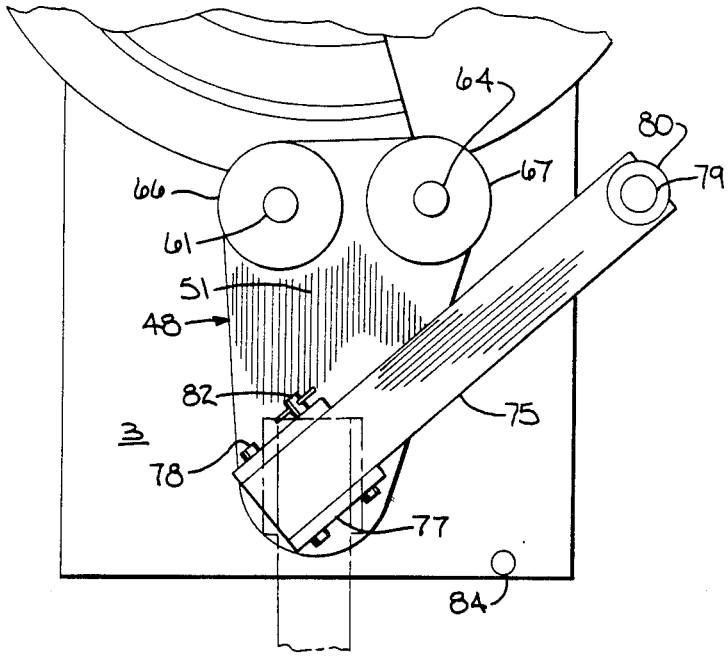
FIG. 6 is a fragmentary top view of the conduit bender of FIG. 1 showing the roller assembly in its operative position for bending larger diameter conduit.

In operation, lever arm 75 and eccentric 74 provide the means for moving the roller units between their operative and inoperative positions. In particular, lever arm 75 and eccentric 74 provide a means for squeezing thinwall conduit which is necessary in order to obtain a kink-free bend. Thus, when lever arm 75 is in the position in solid lines in FIG. 6 the roller units are in their operative positions engaged with the outer surface of a conduit to be bent. In this position the wider portion of eccentric 74 is located to the left of the stationary shaft 49 as seen in FIG. 3. Rotation of eccentric 74 to this position moves the entire roller housing 48 to the left to force a roller unit to engage and squeeze the conduit. The bending shoe 1 is then rotated to obtain the desired angle of bend for the conduit.

After bending the shoe 1 is rotated in the opposite direction by the reversible electric motor 33 back to the initial or zero angle position. Lever arm 5 is then rotated to the position shown by dotted lines in FIG. 6 resulting in the rotation of eccentric 74 so that its wider portion is to the right of shaft 49 substantially as shown in FIG.

4. This rotation moves the roller housing 48 and roller units to the right to their inoperative positions so that the conduit may be removed or unloaded from the apparatus. As is obvious, this position is also the initial position for roller assembly 2 whereby conduit may be inserted or loaded between shoe and a roller unit.

The grip portion 80 of lever arm 75 not only performs the function of enabling an operator to rotate eccentric 74, but also provides the dual function of acting as a backup roller when bending conduit smaller than 1¼ inch nominal diameter sizes. When it is desired to bend rigid, IMC or thinwall conduit of 1 inch, ¾ inch or ½ inch nominal sizes, the polyurethane grip portion 80 acts as a backup roller taking up the moment during bending. As seen in FIG. 7, this operation requires the lever arm 75 to be moved to a position located between roller 66 and bending shoe 1 and engaging roller 66. In order to move lever arm 75 to this position, lever arm 75 is provided with a lock pin 82 which extends through aligned openings in arm 75 and the side walls of bracket 77. Lock pin 82 normally maintains lever arm 75 in a horizontal position for moving the roller units between their operative and inoperative positions. However, in order to move lever arm 75 to the position shown in FIG. 7 from the solid line position shown in FIG. 6 lock pin 82 is removed and arm 75 is pivoted upwardly on pin 78 until it clears the top of rollers 66 and 67. Lever arm 75 may then be rotated to the left over rollers 66 and 67 and then pivoted back down into the position shown in FIG. 7. Lock pin 82 is then reinserted and the entire roller assembly 2 is rotated clockwise as seen in FIG. 7 until a stop flange 83 projecting downwardly from the lower web portion 51 of roller housing 48 engages a stop pin 84 projecting upwardly from frame 3, as shown in FIG. 7. Thus, grip portion 80 is properly positioned for use with 1 inch, ¾ inch and ½ inch bending grooves 16 of either die portions 14 or 15.

A conduit bender has been shown and described which includes a bending shoe 1 and roller assembly 2 which not only may be used with rigid, IMC and thinwall conduit, but may also be utilized with various conduit sizes. The roller assembly 2 includes a plurality of roller units and a lever arm assembly which provides a means for moving the roller units into an operative position for supporting conduit during bending and an inoperative position for loading or unloading conduit. The roller units include a split roller which enables the apparatus to provide a single setup for rigid, IMC and thinwall conduit thus eliminating the need to change rollers or shoes when a different size or type of conduit is to be bent. The conduit bender also includes a means for driving the bending shoe 1 which includes a chain and sprocket arrangement that reduces the bending force on the shoe shaft.

Various modes of carrying out the invention are contemplated as being within the scope of the following claims particularly pointing out and distinctly claiming the subject matter which is regarded as the invention.

We claim:

1. A conduit bending apparatus, comprising:

a frame;

a bending shoe member rotatably mounted about an axis on the frame, said shoe member includes separate arcuate-shaped die portions disposed opposite one another, each die portion having a plurality of conduit-receiving grooves formed therein disposed parallel to one another and axially adjacent one another along the axis of rotation of said shoe, each of said grooves having a diameter differing from the others and substantially equal to the outer diameter of the conduit to be bent in that particular groove;

a support member mounted on the frame for supporting a conduit during bending said support member having a complementary conduit-receiving groove formed therein, said support member comprises a grooved roller mounted for rotation on a roller shaft, and said roller is split along a plane normal to its axis of rotation to form an axially movable member; and adjusting means associated with said support member for varying the diameter of its respective groove, said adjusting means enables said axially movable member to move alone the rotational axis of said roller, and said adjusting means includes retaining means on said roller shaft for engagement with said axially movable member, and said adjusting means moves said shaft axially along its rotational axis; and drive means in driving engagement with one of said members for developing relative motion between said members to bend a conduit disposed between said grooves.

2. The apparatus of claim 1, wherein said roller is split into two halves and said axially movable member comprises one of said halves.

3. The apparatus of claim 1, wherein said adjusting means includes a pin projecting a radially from said shaft, and a key member slidably mounted on said support member and movable relative to said frame, said key member having an inclined cam surface thereon for sliding engagement with said pin.

4. A conduit bending apparatus, comprising:

a frame;

a bending shoe member rotatably mounted about an axis on the frame, said shoe member includes separate arcuate-shaped die portions disposed opposite one another, each die portion having a plurality of conduit-receiving grooves formed therein disposed parallel to one another and axially adjacent one another along the axis of rotation of said shoe, each of said grooves having a diameter differing from the others and substantially equal to the outer diameter of the conduit to be bent in that particular groove;

a roller member rotatably mounted on the frame for supporting conduit during bending, said roller member having a complementary conduit-receiving groove formed therein;

an adjusting means associated with said roller member for varying the diameter of its respective groove;

positioning means for moving one of said members between an operative position wherein said grooves tightly engage the periphery of a conduit disposed therebetween and an inoperative position, said positioning means includes means movable to a position adjacent said bending shoe member for cooperation therewith to bend conduit with said roller member being in inoperative position; and drive means in driving engagement with one of said members for developing relative motion between said members to bend said conduit.

5. The apparatus of claim 4, wherein said positioning means includes eccentric means rotatably mounted on the frame, and lever arm means for rotating the eccentric means.

6. The apparatus of claim 4, wherein said roller member is split along a plane normal to its axis of rotation to form an axially movable member, and said adjusting means enables said axially movable member to move axially along its rotational axis.

7. The apparatus of claim 6, wherein said roller member is split into two disc members movable between a closed position and an axially separated position.

8. A conduit bending apparatus comprising:

a frame;

a bending shoe rotatably mounted about an axis on the frame, said bending shoe includes separate arcuate-shaped die portions disposed opposite one another, each die portion having a plurality of conduit-receiving grooves formed therein disposed parallel to one another and axially adjacent one another along the axis of rotation of said shoe, each of said grooves having a diameter differing from the others and substantially equal to the outer diameter of the conduit to be bent in that particular groove;

drive means for rotating the bending shoe;

a roller assembly mounted on the frame for supporting conduit during bending, said roller assembly including a roller housing, and roller means rotatably mounted on the housing, said roller means including a roller having a complementary conduit-receiving groove formed therein and being split along a plane normal to its axis of rotation to form a pair of disc members;

adjusting means for adjusting the axial position of one of said disc members to vary the diameter of said complementary groove to substantially correspond to the outside diameter of the conduit to be bent, said adjusting means includes retaining means on the shaft member, and a key member slidably mounted on said roller housing and movable relative to said frame and disposed normal to the axis of rotation of said split roller, said key member having an inclined cam surface formed thereon for engagement with a pin projecting from said roller shaft to move said shaft axially upon sliding movement of said key member whereby said retaining means moves said one disc member axially to change the diameter of said complementary groove; and positioning means for moving said roller means between an operative and an inoperative position.

9. The apparatus of claim 8, wherein said roller means further includes a companion grooved roller disposed adjacent said split roller on the roller housing rotatable about an axis that is parallel to the axis of said split roller.

10. A conduit bending apparatus, comprising:

a frame;

a bending shoe member mounted on the frame, said shoe member having a conduit-receiving groove formed therein;

a support member mounted on the frame for supporting conduit during bending, said support member having a complementary conduit-receiving groove formed therein, said support member includes a grooved roller mounted for rotation on a roller shaft, said roller is split along a plane normal to its axis of rotation to form an axially movable member;

an adjusting means associated with said roller for varying the diameter of its respective groove, said adjusting means includes retaining means on said roller shaft for engagement with said axially movable member, a pin projecting radially from said shaft, and a key member slidably mounted on said support member and movable relative to said frame, said key member having an inclined cam surface thereon for sliding engagement with said pin to move said shaft axially along its rotational axis; and drive means in driving engagement with one of said members for developing relative motion between said members to bend a conduit disposed between said grooves.

11. A conduit bending apparatus comprising:

a frame;

a bending shoe rotatably mounted on the frame having a conduit-receiving groove formed therein;

drive means for rotating the bending shoe;

a roller assembly mounted on the frame for supporting conduit during bending, said roller assembly including a roller housing, and roller means rotatably mounted on the housing, said roller means including a roller having a complementary conduit-receiving groove formed therein and being split along a plane normal to its axis of rotation to form a pair of disc members;

adjusting means for adjusting the axial position of one of said disc members to vary the diameter of said complementary groove to substantially correspond to the outside diameter of the conduit to be bent, said adjusting means includes retaining means on the shaft of said split roller for engagement with said one disc member, and a key member slidably mounted on said roller housing and movable relative to said frame and disposed normal to the axis of rotation of said split roller, said key member having an inclined cam surface formed thereon for engagement with a pin projecting from said roller shaft to move said shaft axially upon sliding movement of said key member whereby said retaining means moves said one disc member axially to change the diameter of said complementary groove; and positioning means for moving said roller means between an operative and an inoperative position.

12. A conduit bending apparatus, comprising:

a frame;

a bending shoe member mounted on the frame, said shoe member having a conduit-receiving groove formed therein;

a roller member rotatably mounted on the frame for supporting conduit during bending, said roller member having a complementary conduit-receiving groove formed therein, said roller member mounted for rotation on a roller shaft and split along a plane normal to its axis of rotation to form an axially movable member;

an adjusting means associated with said roller for varying the diameter of its respective groove, said adjusting means includes retaining means on said roller shaft for engagement with said axially movable member, a pin projecting radially from said shaft, and a slidable key member mounted on said roller member and movable relative to said frame, said key member having an inclined cam surface thereon for sliding engagement with said pin to move said shaft axially along its rotational axis;

positioning means for moving one of said members between an operative position wherein said grooves tightly engage the periphery of a conduit disposed therebetween and an inoperative position; and drive means in driving engagement with one of said members for developing relative motion between said members to bend said conduit.

13. A conduit bending apparatus, comprising:

a frame;

a bending shoe member mounted on the frame defining a first axis, said shoe member having a conduit-receiving groove formed therein;

a roller member mounted on the frame for supporting conduit during bending, said roller member including a roller housing pivotally mounted about a second axis parallel to said first axis for movement in a plane transverse to said second axis, and roller means rotatably mounted on the housing, said roller means including a first roller having a complementary conduit-receiving groove formed therein;

positioning means for moving said first roller between an operative position wherein said grooves tightly engage the periphery of a conduit disposed therebetween and an inoperative position, said positioning means includes an eccentric located at said second axis and a lever arm attached at one end to said eccentric for rotating said eccentric, said lever arm includes a second roller rotatably mounted at its free end, said arm being movable between a first position wherein said arm and eccentric rotate to move said first roller between said operative and inoperative positions and a second position wherein said arm is positioned between said first roller and said bending shoe member so that said second roller is positioned in operative position with said bending shoe member for bending conduit;

stop means on said frame engageable by said roller housing when said arm is positioned in its second position for preventing pivotal movement of said roller housing; and drive means in driving engagement with one of said members for developing relative motion between said members to bend conduit.

14. A conduit bending apparatus, comprising:

a frame;

a bending shoe member rotatably mounted on the frame defining a first axis, said shoe member includes separate arcuate-shaped die portions disposed opposite one another, each die portion having a plurality of conduit-receiving grooves formed therein disposed parallel to one another and axially adjacent one another along said first axis, each of said grooves having a diameter differing from the others and substantially equal to the outer diameter of a conduit to be bent in that particular groove;

a support member mounted on the frame for supporting conduit during bending, said support member including a roller housing pivotally mounted about a second axis parallel to said first axis for movement in a plane transverse to said second axis, and roller means rotatably mounted on the housing, said roller means including a first roller having a complementary conduit-receiving groove formed therein;

positioning means for moving said support member transversely between an operative position wherein said grooves tightly engage the periphery of a conduit disposed therebetween and an inoperative position, said positioning means includes means movable to a position adjacent said bending shoe member for cooperation therewith to bend conduit with said roller means being in inoperative position; and drive means in driving engagement with one of said members for developing relative motion between said members to bend a conduit.

15. The apparatus of claim 14 wherein said first roller is split along a plane normal to its axis of rotation to form a pair of disc members separable to vary the diameter of said complementary conduit-receiving groove.

16. The apparatus of claim 15 further including adjusting means for adjusting the axial position of one of said disc members to vary the diameter of said complementary groove to substantially correspond to the outside diameter of a conduit to be bent.

17. A conduit bending apparatus, comprising:

a frame;

a bending shoe member mounted on the frame defining a first axis, said shoe member having a conduit-receiving groove formed therein;

a roller member mounted on the frame for supporting conduit during bending, said roller member including a roller housing pivotally mounted about a second axis parallel to said first axis for movement in a plane transverse to said second axis, and roller means rotatably mounted on the housing, said roller means including a first roller having a complementary conduit-receiving groove formed therein;

positioning means for moving said first roller between an operative position wherein said grooves tightly engage the periphery of a conduit disposed therebetween and an inoperative position, said positioning means includes means movable to a position adjacent said bending shoe member for cooperation therein to bend conduit with said first roller means being in inoperative position; and drive means in driving engagement with one of said members for developing relative motion between said members to bend conduit.

18. A conduit bending apparatus comprising:

a frame;

a bending shoe rotatably mounted about an axis on the frame, said bending shoe includes separate arcuate-shaped die portions disposed opposite one another, each die portion having a plurality of conduit-receiving grooves formed therein disposed parallel to one another and axially adjacent one another along the axis of rotation of said shoe, each of said grooves having a diameter differing from the others and substantially equal to the outer diameter of the conduit to be bent in that particular groove;

drive means for rotating the bending shoe;

a roller assembly mounted on the frame for supporting conduit during bending, said roller assembly including a roller housing, and roller means rotatably mounted on the housing, said roller means including a roller having a complementary conduit-receiving groove formed therein and being split along a plane normal to its axis of rotation to form a pair of disc members;

adjusting means for adjusting the axial position of one of said disc members to vary the diameter of said complementary groove to substantially correspond to the outside diameter of the conduit to be bent; and positioning means for moving said roller means between an operative and an inoperative position, said positioning means includes an eccentric and a lever arm attached at one end to said eccentric to rotating said eccentric, said lever arm includes a roller rotatably mounted at its free end, said arm being movable to a position wherein said roller may be utilized to bend relatively small diameter conduit.

* * * * *